United States Patent [19]

Hirose

[11] 4,278,253

[45] Jul. 14, 1981

[54] GAME HAVING A SPIRALLY TRAVERSING CHANNEL

[75] Inventor: Tomiyuki Hirose, Tokyo, Japan

[73] Assignee: Tomy Kogyo Co., Inc., Tokyo, Japan

[21] Appl. No.: 81,397

[22] Filed: Oct. 3, 1979

[30] Foreign Application Priority Data

Oct. 11, 1978 [JP] Japan ..... 53-139506[U]

[51] Int. Cl.[3] ..... A63F 9/02

[52] U.S. Cl. ..... 273/121 R; 273/127 R; 273/354

[58] Field of Search ..... 273/119 R, 119 A, 121 R, 273/121 A, 122 R, 122 A, 123 R, 123 A, 124 R, 124 A, 125 R, 125 A, 127 R, 354

[56] References Cited

U.S. PATENT DOCUMENTS

| | | | |
|---|---|---|---|
| 1,896,915 | 2/1933 | Peo | 273/121 R X |
| 2,497,390 | 2/1950 | Anthony | 273/124 A X |
| 3,559,990 | 2/1971 | Philpot . | |
| 3,649,019 | 3/1972 | Barlow . | |
| 3,747,930 | 7/1973 | Barlow . | |
| 3,843,129 | 10/1974 | Dietrich . | |
| 3,980,302 | 9/1976 | Meyer . | |
| 3,997,163 | 12/1976 | Cooper et al. . | |
| 4,109,914 | 8/1978 | Matsumoto | 273/354 |

*Primary Examiner*—Anton O. Oechsle
*Attorney, Agent, or Firm*—K. H. Boswell; Edward D. O'Brian

[57] ABSTRACT

A pinball-type game includes a housing having a playing surface located within the interior of the housing and a spirally winding object guide channel depressed in this playing surface. The channel includes a launching end and a target end at its opposite ends. The channel is sized to allow one of a plurality of objects located within the housing to move within the confines of the channel. An object launcher is located at the launching end of the channel and is capable of launching an object into the channel so as to cause the object to travel within the channel along a spiral pathway until it reaches the target end of the channel. A target is located at the target end of the channel. The target being of the type wherein it is capable of capturing the object only for a finite period of time. The target is under control of a target activation member which activates the target for the finite period of time and if an object successfully traverses the channel and arrives at the target during this finite period of time the object can be successfully captured by the target. If the object does not arrive at the proper time the object is not captured by the target.

15 Claims, 4 Drawing Figures

GAME HAVING A SPIRALLY TRAVERSING CHANNEL

BACKGROUND OF THE INVENTION

This invention is directed to a game in which an object is propelled through a spirally winding pathway toward a target which is capable of capturing the object only if the object arrives at the target concurrently when the target is activated.

Many games are known or have been known. Certain of these games, because of their interest level, tend to have a longer life time than others. Some of the life time of a game can be attributed to the fact that the game seems to incorporate ideas and/or functions which transcend fads. Other games simply have as their greatest appeal the incorporation of characters or objects currently in vogue, that is, their appeal is based strictly on a fad and interest in the game is gone as soon as the fad fades.

Children's games should do more than simply provide a vehicle for occupying their time. It is possible to incorporate ideas into a game which helps a child more effectively deal with his environment. One such thing which can be incorporated into a game is a teaching or practicing of effective eye-hand coordination skills which help a child in manipulating objects of his environment.

Certain target and pinball-type games do help develop eye-hand coordination. The typical pinball-type game utilizes a sphere on a playing surface which is manipulated between a plurality of targets by the use of flippers incorporated in the pinball game. Other games, such as the game described in U.S. Pat. No. 3,997,163 utilize targets which are only exposed for a limited period of time and thus require the user of the game described in this patent to quickly ascertain whether or not a target is exposed and then to attempt to fire an object at that target. In another game described in U.S. Pat. No. 3,649,019 a player must effectively make a decision in a very short period of time whether or not an object belongs to a color group which he must capture or whether that object is outside of that color group and in another color group which he must not attempt to capture. These games help the user to develop skills in mentally recognizing something and then attempting to effectively perform a physical act in association with the mental recognition.

Certain games have been developed which utilize curved surfaces. Thus, in the game described in U.S. Pat. No. 3,980,302 a player must roll an object across a curved surface. For proper capture of the object the object must traverse the curved surface along the curved pathway. Further, in U.S. Pat. No. 3,559,990 it is proposed to use a circular parabolic shaped surface in a bowling-type game. Both of these games require mastery of the knowledge of how an object behaves on a curved surface, a concept which seemingly is more difficult to grasp than how an object behaves on a plane surface.

Just about all pinball-type games incorporate the use of an arculate surface to initially change the direction of the spherical object used in the pinball game from a direction away from the player when the object is launched, to a direction toward the player across the playing surface. The use of this curved surface is essentially only for changing the direction of the spherical object.

It is considered that it would be advantageous to have available a pinball-type game which incorporated a curved track which thus could effectively increase the length of the track within the confines of the housing of the pinball game. It is further considered advantageous to incorporate a variable target member in a game having a curved track in order to develop eye-hand coordination which is based upon curved movement as opposed to straight movement.

BRIEF SUMMARY OF THE INVENTION

It is an overall object of this invention to provide a game which fulfills the criteria set out in the preceding paragraph. It is a further object to provide a game which is simple in construction and therefore can be economically produced and thus available to a large segment of consumers.

These and other objects as will become evident from the remainder of this specification will be achieved by providing a game which comprises: a housing having a transparent cover and including a playing surface located within the interior of the housing beneath the transparent surface; the playing surface includes a spirally winding object guide means, said guide means having a launching end and a target end; at least one object located within the housing beneath the cover and capable of fitting and moving within the guide means; an object launching means located within the housing and operatively connecting to the launching end of the guide means and capable of launching an object into the guide means from the launching end to the target end; a target means located at the target end of the guide means; a target activation means operatively associated with the guide means and capable of activating the target means for a finite time period such that when the object travels through the guide means and concurrently arrives at the target during said finite time period when the target is activated by the target activation means the target is capable of capturing the object.

The spirally winding object guide means preferably includes the playing surface having a spirally winding channel depressed in the playing surface which defines a spirally winding pathway for the object to travel in. The target means is preferably located within the interior of the spiral and the launching means at the exterior of the spiral. Preferably additionally associated with the target means is an auxiliary object capture means which will capture the object if the object arrives at the target at a time other than the finite time when the target is activated by the target activation means.

Figure 1:
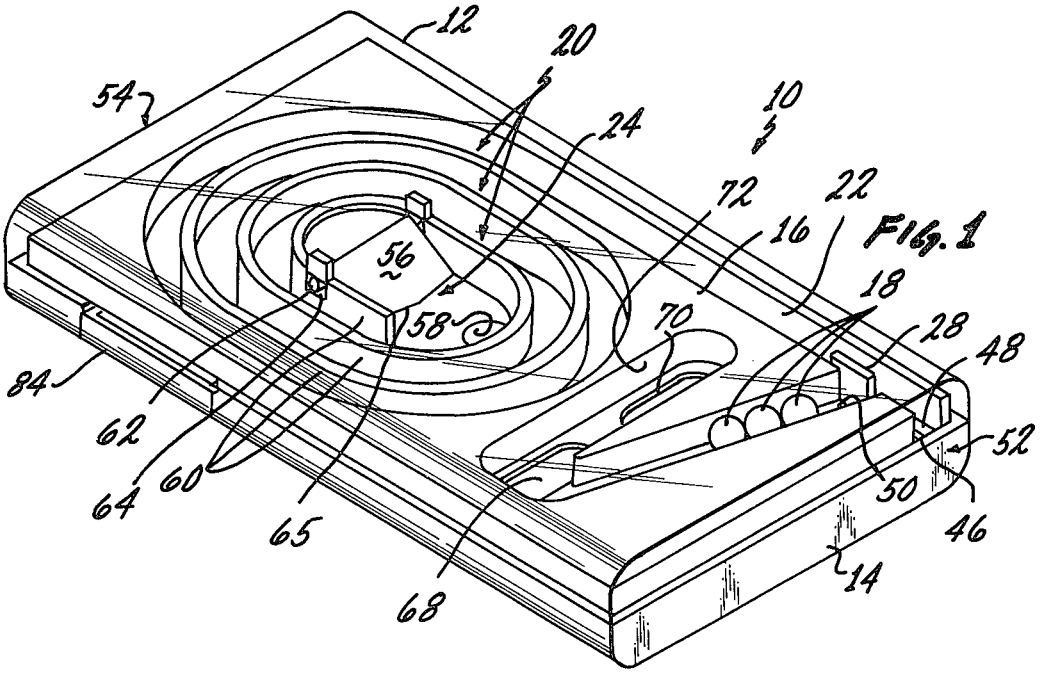
FIG. 1 is an isometric view of the preferred embodiment of the invention.

The invention described in this specification and illustrated in the drawings utilizes certain operative principles and concepts as are set forth and defined in the claims appended to this specification. Those skilled in the toy arts will realize that these principles and concepts can be used with a number of differently appearing and differently describable embodiments. For these reasons this invention is to be construed in light of the claims appended hereto and is not to be construed as to be limited as to the exact embodiment illustrated in the specification and the drawings.

DETAILED DESCRIPTION

The game 10 has a two piece outer housing consisting of a transparent upper section 12 and an opaque bottom section 14. The transparent upper section 12 allows the player of the game to view that area of the game wherein all the motion and the action take place yet confines the movable components, as hereinafter described, within the housing so that they are not misplaced. Located internal the housing beneath the upper section 12 is a playing surface 16. A plurality of objects collectively identified by the numeral 18 are located within the housing in association with the playing surface 16.

Figure 2:
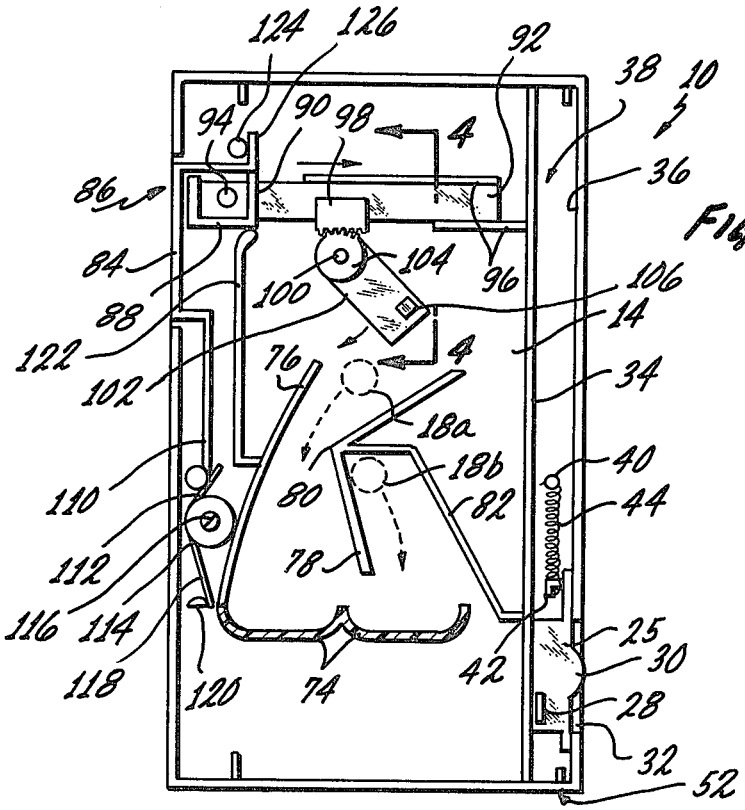
FIG. 2 is a top plan view of the lowermost half of the invention shown in FIG. 1 and shows certain internal components not visible in FIG. 1.

A channel 20 initially starting along the right hand side, as seen in FIGS. 1 and 2 extends upwardly and then wraps about itself in a spirally winding manner. The end of the channel near the right hand side of the game 10 is the launching end 22 and the end within the internal loops of the spiral is the target end 24.

A launching member 25 includes a vertically oriented projection 28 and a horizontally oriented button 30 integrally formed on it. A cutout 32 in bottom section 14 allows button 30 to extend outwardly through bottom section 14 and be accessible to manipulation by a player's fingers. A rib 34 extends along the right hand side of bottom section 14 and together with right hand wall 36 of bottom section 14 forms a guide channel 38 for launching member 26. A peg 40 projects upwardly from bottom section 14 within the confines of channel 38. A small hook 42 is integrally formed with launching member 36 and a spring 44 fits over both the peg 40 and the hook 42 and biases the launching member 26 toward the peg 40. The launching end 22 of channel 20 has a small linear slit 46 along the bottom surface 48 of channel 20. The vertical projection 28 of launching member 26 fits through this slit 46 locating the vertical projection 28 within the channel 20.

An object feed chute 50 extends obliquely to channel 20 in playing surface 16. The feed chute 50 serves as a reservoir for objects 18 prior to their use in playing the game. The launching member 26 is pulled back against the bias of spring 44 by the player of the game via button 30. When the vertical projection 28 moves along slit 46 toward end 52 of the game 10 an object 18 is fed from the feed chute 50 into the channel 20 and comes to rest against the vertical projection 28. Both the width of the channel 20 and the amount of movement of vertical projection 28 towards end 52 are chosen such that only one object at a time is fed from the feed chute 50 into the channel 20. When the button 30 is released from the finger of the player spring 44 pulls launching member 26 toward the other end 54 of the game 10 causing the object 18 located against the vertical projection 28 to be accelerated up the channel 20.

As the object 18 accelerates up the channel 20 it is forced to follow the spiral winding of the channel 20 until it is located at the target end 24 of the channel 20. Located at the target end 24 is the target 56 and an auxiliary object hole 58. The auxiliary object hole 58 is sized to allow an object 18 to pass through it. Additionally the auxiliary object hole 58 lies proximal to the upstanding vertical wall 60 which defines certain portions of the spiral channel 20. If the object 18 is only given enough momentum by the launch member 26 to just cause it to travel through the channel 20 and arrive at the target end 24 at or near a zero velocity, the object 18 will simply feed around the wall 60 and drop into the auxiliary object hole 58. If, however, the object 18 is given sufficient momentum to cause it to feed around wall 60 at a high velocity it will be held against wall 60 by centrifugal force and will pass over auxiliary object hole 58 and be propelled toward target 56.

Figure 4:
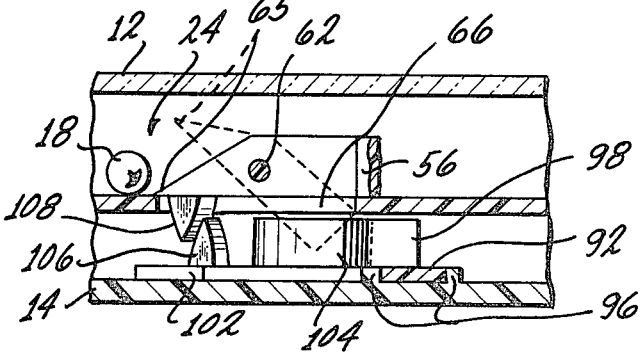
FIG. 4 is a partial side elevational view in section about the line 4—4 of FIG. 2.

The target 56 includes a short axle segment, collectively identified by the numeral 62, located on either side. The axle segments are appropriately located in cutouts collectively identified by the numeral 64 in the wall 60 which act as bearings for the axles 62. This allows the target 56 to pivot about the axle segment 62 such that its front edge 65 can be lifted as is best seen in FIG. 4 allowing access to a hole 56 in the target end 24 of channel 20. The hole 66 is large enough to allow an object 18 to pass through it into the area below the playing surface 16.

A hit window 68 and a miss window 70 are located in an elongated depression 72 in the playing surface 16. Feed chute 50 leads from the depression 72 and as hereinafter explained, after a player has used up all of his objects 18 these objects will be located in either the hit window 68 or the miss window 70 and from there the player can restart the game by tipping the game upside down and allowing the objects 18 to pass through the windows 68 and 70 into the depression 72 and from there into the feed chute 50.

Figure 3:
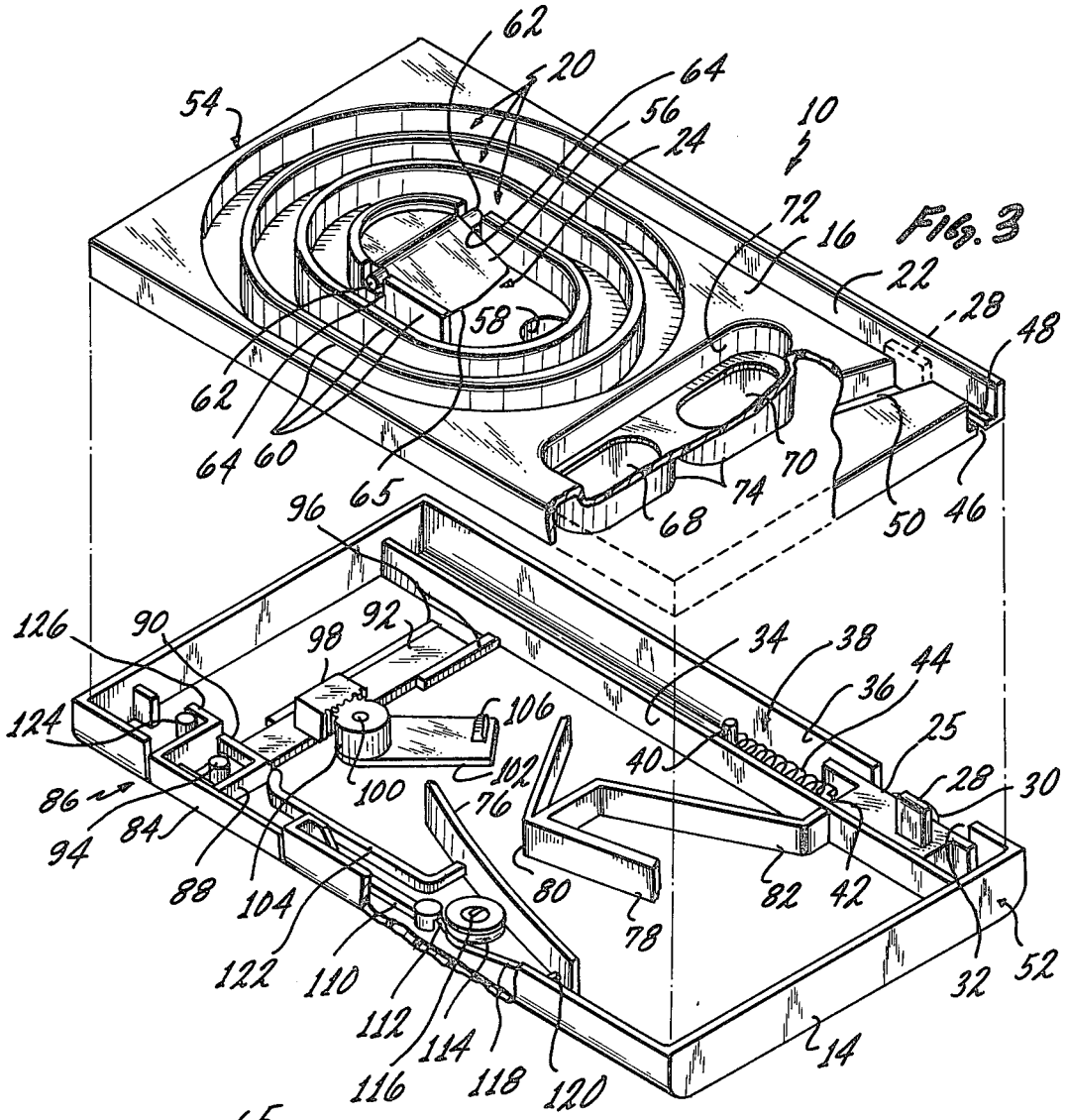
FIG. 3 is an exploded isometric view of portions of the embodiment illustrated in FIG. 1 showing the relationship of the internal working components with those components visible in FIG. 1.

As best seen in FIG. 3 projecting downwardly from the underside of playing surface 16 is a baffle 74 shaped somewhat like an elongated "W" which mimics the shape of the hit windows 68 and 70. Extending upwardly from the surface of bottom section 14 are a series of baffles. The first of these, baffle 76 extends from the left hand side of baffle 74 upwardly below the target 56. To the right of baffle 76 is a baffle 78 which has almost a 90 degree bend in it. A point 80 at this bend is located slightly to the left of auxiliary hole 58. A baffle 82 meets baffle 78 at point 80. If an object 18 falls through auxiliary object hole 58 it falls into the area surrounded by baffles 78 and 82 and will roll downwardly and come to rest against baffle 74 directly below miss window 70. If an object successfully passes underneath target 56 and then through hole 66 it will roll between baffles 76 and 78 and come to rest against baffle 74 directly below hit window 68. The phantom objects **18*a* and 18*b* shown in FIG. 2 show the appropriate movement of the objects 18 after object 18*a* has passed through hole 66 and 18*b* has passed through hole auxiliary hole 58**.

The target 56 is controlled by target button 84 which can be seen on the left side of the bottom section 14 in FIGS. 1; 2 and 3. When the target button 84 is depressed the target is activated such that its front edge 65 is lifted and then immediately distends again. When the target button 84 is released this same action is repeated. The target 56 cannot be maintained in an open position. That is, its front edge 65 cannot be maintained in its upwardly oriented position by maintaining the target button 84 is a depressed position. The front edge 65 can be raised at the will and whim of the player pushing the target button 84, however, it descends completely under its own control and not under the player's control. Thus, the target 56 will only be opened allowing access to hole 66 for a finite period of time each time the target button 84 is depressed.

If an object 18 arrives in the target end 24 of channel 20 precisely at the moment that front edge 65 is raised that object 18 can be successfully captured by the target 56 and the object 18 will descend through the hole 66 and be displayed in the hit window 68. If the object 18 arrives either before or after the front edge 65 of the target 56 is raised the target 56 will prevent the object 18 from going through the hole 66. The object 18 will then roll back in the target end 24 and fall in the auxiliary object hole 58 and become visible below the miss window 70.

The target 56 is connected to the target button 84 via several components. On end 86 of target button 84 is a boxlike enclosure 88. The wall 90 of enclosure 88 which is parallel to the outer surface of target button 84 does not extend all of the way downwardly toward the surface of bottom section 14, but is cutout. A sliding member 92 extends below the wall 90 in the cutout and it includes an upstanding peg 94 which is located within the interior box like enclosure 88 and is retained there by the shape of the enclosure 88. Two upstanding ribs collectively identified by the numeral 96 are located on the surface of bottom section 14 and serve as a guide for sliding member 92 allowing sliding member 92 to move back and forth traversely to the longitudinal axis of the game 10. When the target button 84 is depressed its motion is transferred via peg 94 to sliding member 92.

Located in the center of sliding member 94 is a small gear rack section 98. An upstanding axle 100 is located proximal to gear rack 98. A flat member 102, having a pinion 104 fixed on one end, has a hole, not shown or numbered, allowing it to be located over axle 100 engaging pinion 104 with gear rack 98. A wedge 106 projects upwardly on the other end of flat member 102. When button 84 is depressed the motion of sliding member 92 is transferred via gear rack 98 to pinion 104 causing flat member 102 to swing about axle 100 and consequently wedge 106 to move through an arc.

Located on the bottom surface of target 56 is an identical wedge 108. Wedge 108 is located near front edge 64 of target 56. When flat member 102 rotates about axle 100 wedge 106 comes in contact with wedge 108 and because of their shape they slide along one another. As the wedges 106 and 108 slide against one another wedge 108 is elevated which in turn elevates front edge 64. As soon as the points (not numbered) of these wedges pass each other wedge 108 descends causing target 56 to close.

End 110 of target button 84 is connected to end 112 of helical spring 114. Helical spring 114 is fixedly located via screw 116 onto bottom section 14 and its other end 118 is fixedly held by post 120 extending upwardly from bottom section 14. The limit of travel of button 84 into the interior of the game 10 is controlled by rib 122 which is formed on the surface of bottom section 114. The limit of travel of button 84 out of the bottom section 14 of the game 10 is limited by peg 124 which interacts with projection 126 formed on the box like enclosure 88.

Button 84 when depressed into the game 10 goes against the bias of helical spring 114. When the button 84 is released the bias of helical spring 114 returns button 84 into a resting position wherein projection 126 fits against peg 124. Additionally during this return trip sliding member 92 slides back to its original position causing wedge 106 to move in an arc (clockwise) as seen in FIG. 2. This also causes wedge 106 to again interact with wedge 108 and thus the target 56 is lifted once when the target button 84 is depressed and also once when it is released. It is possible to therefore capture an object 18 with the target 56 on either pressing the target button 84 or releasing the same.

I claim:

1. A game which comprises:
   - a housing including a playing surface located within the interior of said housing;
   - said playing surface including a spirally winding object guide means, said guide means having a launching end and a target end;
   - at least one object located within said housing and capable of fitting and moving within said guide means;
   - an object launching means located in said housing and operatively connecting to said launching end of said guide means and capable of launching an object into said guide means so as to cause said object to travel within said guide means from said launching end to said target end;
   - a target means located at said target end of said guide means;
   - a target activation means controlled by the operator of said game, said target activation means operatively associated with said target means and capable of activating said target means for a finite period of time in response to control by said operator, the operator of said toy capable of coordinating the activation of said target means with the arrival of said object at said target means such that when said object travels through said guide means and concurrently arrives at said target end of said guide means during said finite period of time when said target is activated by said target activation means said target is capable of capturing said object.
2. The game of claim 1 wherein:
   - said spirally winding object guide means comprises a spirally winding channel in said playing surface traversing in said playing surface between said object launching means and said target means.
3. The game of claim 2 wherein:
   - said target means is located centrally within the interior of said spirally winding channel.
4. The game of claim 3 including:
   - an auxiliary object capture means located proximal to said target means in said spirally winding channel and capable of capturing said object when said object travels through said spirally winding channel and arrives at said target means during the time period when said target is not activated by said target activation means.
5. The game of claim 4 including:
   - a plurality of objects each comprising a spherical object.
6. The game of claim 5 including:
   - a scoring means substantially capable of indicating when any of said objects are captured by said target and when any of said objects are captured by said auxiliary capture means.

7. The game of claim 6 wherein:

said target means comprises said playing surface having a target opening sized to receive one of said objects, a cover means operatively associated with said target activation means and reversibly covering said target opening in response to said target activation means.

8. The game of claim 7 wherein:

said auxiliary object capture means comprises said playing surface including an auxiliary hole located within said spirally winding channel, said hole sized to receive any of said objects.

9. The game of claim 8 wherein:

said scoring means comprises said playing surface having a hit window and a miss window located adjacent to said spirally winding channel and including an object hit guiding means operatively associated between said hit window and said target opening and an object miss guiding means operatively associated between said miss window and said auxiliary hole such that an object passing through said target opening is guided to said scoring window and an object passing through said auxiliary hole is guided to said miss window.

10. A game which comprises:

a housing having a bottom section and a top section, at least the top section being transparent allowing the viewing into the interior of the housing;

a surface located within the interior of the housing beneath the top section;

a spirally winding channel means located in association with said surface and having a bottom wall and along at least a portion of its length a concave wall and an opposing convex wall;

at least one object located within said housing, said object sized to fit within said channel means between the concave and convex walls;

an object launching means operatively associated with one end of said channel means and capable of propelling said object at different velocities through said channel means;

a target means operatively associated with said channel means and located distal from said launching means, said target means comprises said playing surface having an opening passing through said playing surface and opening below said playing surface, said opening sized to receive said object, a cover means associated with said opening and in an unactivated position covering said opening preventing said object from passing through said opening means associated with said cover means and controllable by an operator of said game, said means capable of activating said cover means to move said cover means to an activated position wherein said object is capable of passing through said opening;

an auxiliary object capture means located on said bottom wall of said channel means and capable of capturing said object if said object is propelled through said channel means at a low velocity such that said object is not held against said concave wall by centrifugal force imparted to said object by the velocity of said object through said channel means.

11. The game of claim 10 wherein:

said target means includes a target having a capture mode and a non-capture mode;

a target activation means operatively associated with said target and capable of activating said target from said non-capture mode into said capture mode.

12. The game of claim 11 wherein:

said target is maintained in said capture mode for a finite period of time followed by return of said target to said non-capture mode.

13. A game which comprises:

a housing having a bottom section and a top section, at least the top section being transparent allowing viewing into the interior of the housing;

a surface located within the interior of the housing beneath the top section;

a spirally winding channel means located in association with said surface and having a bottom wall and along at least a portion of its length a concave wall and an opposing convex wall;

at least one object located within said housing, said object sized to fit within said channel means between the concave and convex walls;

an object launching means operatively associated with one end of said channel means and capable of propelling said object at different velocities through said channel means;

a target means operatively associated with said channel means and located distal from said launching means;

said target means includes a target having a capture mode and a non-capture mode;

a target activation means operatively associated with said target and capable of activating said target from said non-capture mode into said capture mode, said target activation means including at least a portion accessible to the operator of said game such that the operator of said game is capable of controlling activation of said target from said non-capture mode to said capture mode, said target means returning from said capture mode to said non-capture mode independently with respect to said activation of said target to said capture mode by said operator.

14. The game of claim 13 wherein:

said target is maintained in said capture mode for a finite period of time followed by return of said target to said non-capture mode.

15. The game of claim 14 including:

an auxiliary object capture means located on said bottom wall of said channel means and capable of capturing said object if said object is propelled through said channel means at a low velocity such that said object is not held against said concave wall by centrifugal force imparted to said object by the velocity of said object through said channel means.

* * * * *